United States Patent [19]

Dice et al.

[11] 4,328,692

[45] May 11, 1982

[54] BOOBY-TRAPPED LOCK CYLINDER WITH INTEGRAL INTRUSION DETECTOR

[76] Inventors: Harry E. Dice, 3552 Oak Dr., Edgewater, Md. 21037; George K. C. Hardesty, P.O. Box 130, Mayo, Md. 21106

[21] Appl. No.: 132,886

[22] Filed: Mar. 24, 1980

Related U.S. Application Data

[63] Continuation-in-part of Ser. No. 895,708, Apr. 12, 1978, Pat. No. 4,194,379.

[51] Int. Cl.[3] ..... E05B 63/00

[52] U.S. Cl. ..... 70/421; 70/441; 70/DIG. 49

[58] Field of Search ..... 70/363, 364 A, 419, 70/421, 431, 441, DIG. 49

[56] References Cited

U.S. PATENT DOCUMENTS 3,878,700 4/1975 Lopez ..... 70/363
3,986,376 10/1976 Lack ..... 70/364 A
4,194,379 3/1980 Dice ..... 70/421

FOREIGN PATENT DOCUMENTS 197808 2/1977 Fed. Rep. of Germany .... 70/DIG. 49

*Primary Examiner*—Robert L. Wolfe

*Attorney, Agent, or Firm*—Birch, Stewart, Kolasch & Birch

[57] ABSTRACT

A pick-resistant-multiple-pin-tumbler cylinder for a lock is disclosed, the principal embodiments of which include an integral, key-displaceable, booby-trapped, lock-up element within the cylinder shell, and slidably mounted in relation to a portion of the rotationally displacable cylinder plug and in which the lock-up element contains a T-shaped peripheral notch which engages and receives a fixed pin or lug projecting from the bore and is thus both slidably and rotatively received in the shell and spring pressed axially for engagement of its shaped notch with the pin, whereby the peripheral dimension of the notch limits the rotation of the plug to a small angle until the lock-up trapping element is thrust towards the rear of the cylinder through the insertion into the plug's keyway of a properly profiled key, imparting a predetermined linear displacement effecting disengagement of the lock-up element.

Another embodiment employs an inverse relationship of lug and restraining key-slot, in which the lock-up booby trapping means includes a lug that extends from the plug radially and is key displacable longitudinally to effect disengagement from a labyrinth-like T-slot in the bore of the shell upon insertion of a legitimately profiled key, but locks up if attempts are made to rotate the plug through conventional picking procedures.

23 Claims, 18 Drawing Figures

7
8
10
11
18
38
39-40
34
35
36
37
4
5
27
28
26
30
31
29
23
32
24
25
33
39
43
15

BOOBY-TRAPPED LOCK CYLINDER WITH INTEGRAL INTRUSION DETECTOR

This application is a Continuation-in-Part of application, Ser. No: 895,708, filed Apr. 12, 1978, now U.S. Pat. No. 4,194,379 granted to the first named inventor.

BACKGROUND OF THE INVENTION

I. Field of Invention

The present invention relates to an improved, multiple-pin lock cylinder designed to be used as an improved security replacement cylinder in a conventional cylinder type lock, as well as to be the basis for the design of completely new lock mechanisms, incorporating lock-status and intruder-alert information for transmittal to centralized building security systems. This improved lock cylinder is extremely pick-resistant and includes an integral, mechanical, booby-trapped lock-up which functions only when hostile entry is attempted by even the most skilled lock-picking procedures. The several disclosed embodiments of the invention offer practical design options facilitating practical application in spite of the existance of restrictive conventional design and of the highly standardized dimensions that are so well known to manufacturers and locksmiths. As desired, integral sensing or transducing elements may be incorporated as integral components of the cylinders, and connected to communicate information of the lock's status, or to initiate a hostile entry attempt warning into a centralized building security system. The transducing elements may be mechanical, electrical or optical.

II. Description of the Prior Art

The conventional cylinder type lock is well known, widely used and highly regarded, although it has a vulnerability not generally known to the law abiding population. Locksmiths and too many others know that a trained person may "pick" the cylinder of such a lock, and open it without a key. Bent nails, paper clips and hair pins have been used as tools for this purpose. Thus, while such a lock provides adequate protection against unauthorized entry by the average person, it provides relatively little protection against entry by some of those whose access it is most desired to prohibit or control. There is a need therefore, in the art of high security lock design, to provide a relatively simple lock which can exclude the skilled lock picker, but still be ameniable to rekeying and servicing by legitimate mechanics of the locksmithing art, without recourse to the expensive proprietary equipment and supplies required by some contemporary "high-security" cylinder lock systems. Although various locks exist which are more difficult to pick than the conventional multiple-pin tumbler lock, in general those currently offered incorporate in their lock cylinders intricate structures that are expensive to manufacture and/or rely on keys that cannot be duplicated by generally available equipment, causing hardships on the users of such locks when they desire to replace keys or change combinations following loss of keys or changes of personnel or of building occupancy, etc.

SUMMARY OF THE INVENTION

It is a primary object of the present invention to provide a replaceable multiple-pin tumbler lock cylinder which readily can be substituted for a conventional lock cylinder in the lock of a door to provide a degree of tamper resistance previously unobtainable in conventional door locks.

Another primary object of the invention is to provide a lock cylinder of conventional format which lends itself to the design of building locks utilizing conventional mechanisms of the locksmithing art, but providing integral, intrusion-attempt-detecting sensors to communicate with either local or centralized alarm systems.

A more specific object of the invention is to provide a multiple-pin-tumbler lock cylinder including an integral "booby-trap" like auxilliary locking means within the cylinder and carried by the lock plug comprising a pin and an engageable mating labyrinth, not accessible to picking tools to the end that the picking tools and instruments and procedures effective on conventional locks cannot be utilized successfully for picking the lock even in the hands of those accomplished in such procedures and that such attempts will result in springing of the trap, necessitating the return of the key plug to its starting position, and resulting in the undoing of even this partial success in lock picking procedure.

A further object of the invention is to provide a new, generic, pin-tumbler lock cylinder design, having practical constructional features, and which is amenable to incorporation within the designs of a wide variety of contemporary hardware and is producable by current manufacturing procedures, which may be economically manufactured, and which will be efficient and durable in use for accomplishing its intended purpose, and which, further, does not require a uniquely constructed key, which can be re-keyed by the typical locksmith who does not have access to highly specialized key-cutting machines and key blanks that form the basis for most of the prior "high security" restricted access key-and-lock systems.

Various other objects and advantages of the present invention will hereinafter become more fully apparent from the following description of the drawings, illustrating presently preferred embodiments thereof, and wherein:

DETAILED DESCRIPTION OF THE DRAWINGS

Figures 1, 2, 3:
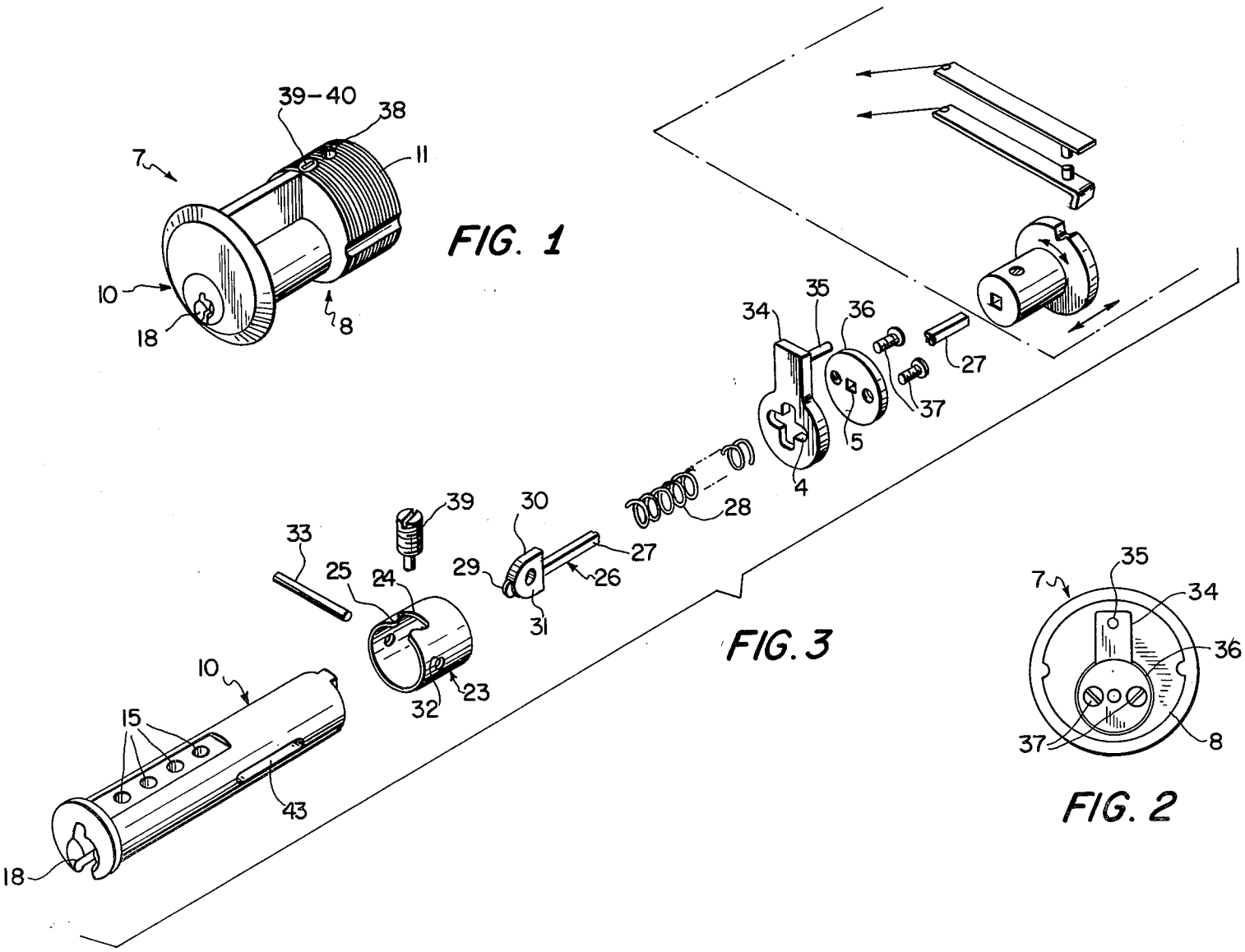
FIG. 1 is a perspective view of the lock cylinder of the present invention looking toward the front end thereof.
FIG. 2 is an end view in elevation of the lock cylinder of FIG. I, looking toward the rear of the lock cylinder.
FIG. 3 is an exploded perspective view of the lock cylinder plug and certain of the parts normally carried thereby, and includes an extending square or splined pin of optional length for communication of angular and linear displacement information to such auxilliary switching elements as may be incorporated in the basic lock mechanism.

Referring to FIGS. 1 through 6, the lock cylinder in its entirety is designated generally 7, and includes a cylindrical shell 8 having an off-center bore 9, extending longitudinally therethrough for receiving a cylinder plug 10 which is mounted rotatively therein. Shell 8 has an externally threaded portion 11 to enable it to be threadedly mounted in a conventional door lock, not shown.

Shell 8 is provided with radially extending sockets 12 each containing a compression spring 13 which seats against the closed end of the socket and which yieldably urges a pin tumbler 14 into bore 9. Plug 10 has sockets 15 in alignment with sockets 12 and which slideably receive pin tumblers 16 and portions of tumblers 14. The rounded inner ends of pin tumblers 16 seat on a longitudinal rib 17 disposed in keyway 18 of plug 10 for supporting the aligned pin tumblers 14 and 16 with their abutting ends out of registration with the faying cylindrical surfaces of plug 10 and bore 9 along a line intersecting the principal axes of all of the tumblers. In practice, this line, known as the "shear line" may actually be part of a very small clearance gap. With no key in keyway 18, pin tumblers 14 are intersected by the "shear line" as shown by FIG. 4, plug 10 cannot be rotated in shell 8 and cylinder bore 9, and the lock mechanism in which the cylinder is assembled is in the locked condition.

Figure 4:
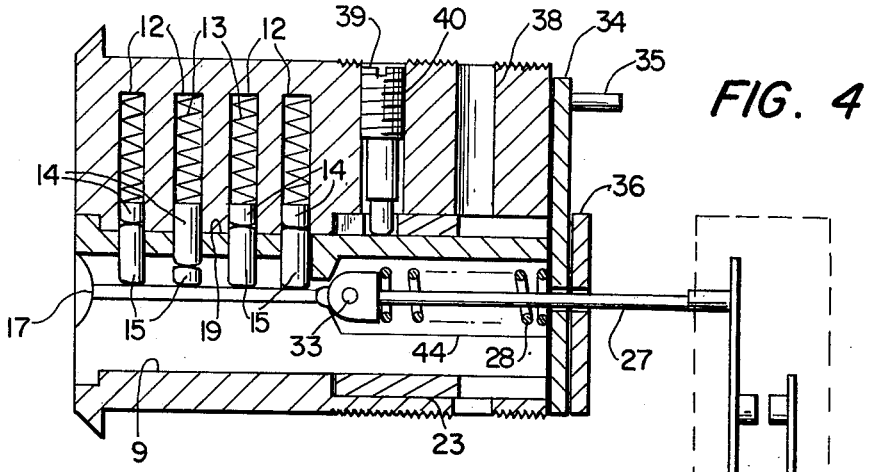
FIG. 4 is a longitudinal, substantially central sectional view of the lock's cylinder of FIG. I, with the plug supported mechanism in the key removed position.
Figure 6:
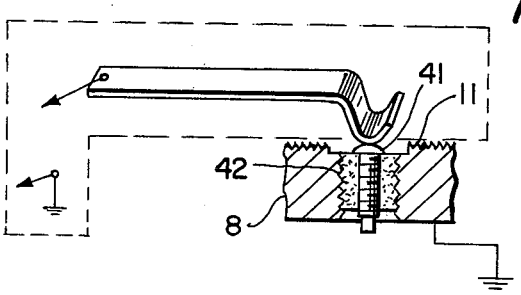
FIG. 6 is a fractional sectional view of the combined booby-trapped lock-up pin and electrical alarm contact for optional incorporation in several embodiments of the invention including FIGS. 1, 2, 3 and 4.
Figure 5:
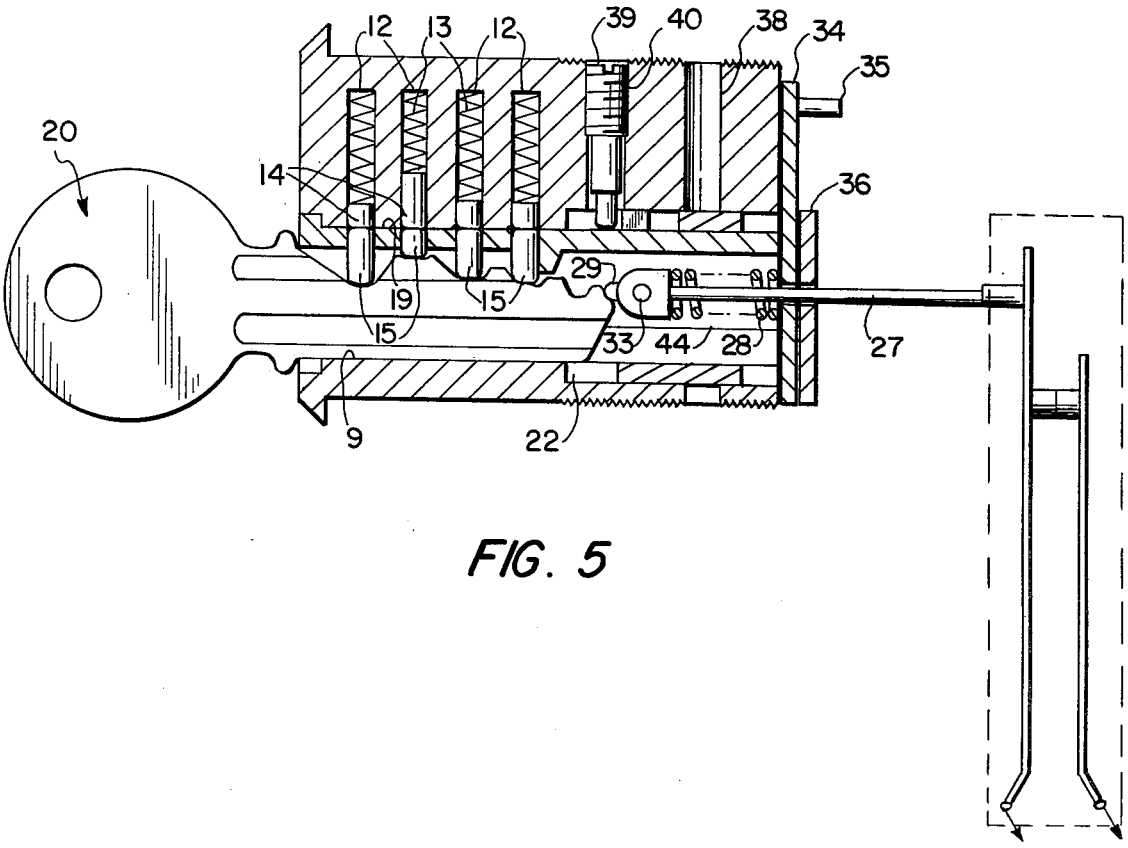
FIG. 5 is identical to FIG. 4, except that the key is shown fully inserted to the tumbler-pin-unlocking and trapping-mechanism-disengaging position.

Key 20 has a blade 21, one edge of which is notched or "bitted" to provide a series of coded grooves whose function it is to lift and support pin tumblers 16 against the forces of springs 13, and which are so dimensioned relative to the several tumblers of various lengths that when key 20 is fully inserted in keyway 18, as seen in FIG. 5, the outer ends of tumblers 16 and the inner ends of 14, against which said outer ends abut, will be in the plane of shear line 19 as in conventional lock cylinders not incorporating this invention. Normally, this would permit key 20 to be turned to rotate plug 10 in shell 8, as in conventional lock cylinders, however, novel features of the improved lock cylinder herein described, come into play in the form of a "mechanical discriminator", which requires additionally that coded information be communicated to the discriminator assembly by the key in the form of a specific increment of displacement of a trigger that has the capability of disengaging the booby-trapped plug-lock-up mechanism. Failure to so disengage these trigger operated elements, as during the course of well known lock picking procedures including simultaneous or subsequent "torquing" of the plug with a lock-picking tool, will result in a plug lock-up as will be appreciated when considering the details of the discriminator as shown in FIGS. 3 and 4. In these figures, bore 9 has an enlarged diameter section 22 at its far end to accommodate a T-shaped labyrinth, contained in lock-up sleeve or collar 23 and which is linearly displaceable out of alignment with stop pin 39 along the axis of rotatable plug 10 and thus, within limits, both linearly and angularly displaceable within the confinces of enlarged bore section 22. As best seen in FIG. 3, collar 23 is coupled to plug 10 by means of cylindrical pin 33 which engages opposing holes 32 in its sides and passes through a clearance slot 43 machined completely through a portion of the rear section of plug 10 to prohibit rotational motion of the collar relative to the plug but to permit free linear displacement of said collar along a section of the plug and accordingly, a transverse from the inner end of bore 22 to the closure at the other end provided by operator or cam 34 which is secured to the rear of plug 10 by means of anchor disc 36 and screws 37. Trigger pin 26 has a swaged portion 30, which contains a clearance hole 31, through which pin 33 is inserted upon assembly. It further has a projection 29 that contacts and engages an open-sided notch 45 in the leading end of key 20.

As shown in FIGS. 4 and 5, plug 10 contains a bore 44 which extends from its rear forward almost to an intersection with the rearmost pin tumbler set 13 and 14, and provides clearance for compression spring 28 and for the enlarged swaged portion of the trigger pin which receives the thrust of compression spring 28. The projecting part 24 of the trigger is thus positioned in the upper part of the keyway at a location that interferes with the use of pin tumbler-picking tools, yet permits engagement with open sided end notch 45 in the bitted edge of the key. Taken together, FIGS. 3 and 4 show that labyrinth 24 of collar 23 is so positioned relative to stop pin 39, that even with the juncture of all of the pin tumblers in the lock cylinder raised to the plug's shear line, the plug can be rotated through only a small angle in either direction before rotation is stopped by contact of the stop pin and the labyrinth. When the trigger and collar assembly have been displaced rearwardly by a predetermined amount, through the insertion of a properly end-coded and bitted key, into the keyway as shown in FIG. 5, collar 23 will assume the relative position shown therein where no engagement with locking pin 28 is possible, and the plug is free to be rotated fully to effect unlocking of the basic lock mechanism into which the cylinder is assembled. It is a purpose of the dimensions and shape of the narrow entrance 25, to the two-lobed labyrinth 24 in collar 23, not only to establish a "booby-trap" to lock-up the plug at the culmination of an otherwise successful tumbler-picking procedure but to compel the return of the plug to its starting position at which angular orientation all the tumblers will reengage and negate the prior tumbler picking procedures.

It will be evident that because the insertion of a legitimately coded key into the keyway of the plug will always displace trigger 26 and collar 23, and that labyrinth 24 will always be displaced linearly without contact of stop pin 39 because of clearance provided at labyrinth entrance 25, and collar 23 will be completely out of alignment with stop pin 39, that no accidental booby-trapping lock-up of the plug can result from subsequent turning of the key and plug, because the (square, splined or rectangular) extending end portion 27 of trigger 26 will always project farther through the opening and clearance holes 4 and 5, provided in operator or cam 34 and the retainer disc 36, when trigger 26 and collar 23 are displaced axially. The information so transmitted by this trigger extension may be utilized by auxillary mechanical lock mechanisms or sensed by electrical sensors including electrical switches.

Specifically, because this pin also rotates in unison with both plug 10 and labyrinth containing sleeve 23, and because the small increment of angular displacement of the plug that is possible within the confines of the labyrinth while sleeve 23 is in its armed, at rest, position can only result from a partially successful attempt at lock picking, a second category of security information may be relayed to auxilliary mechanical alarms, or to elements of cooperating lock mechanisms not shown, or to conventional electrical switching devices. One simple mechanism, designated X in FIG. 3 and indicated schematically therein, includes a notched cam type of operator afixed to the trigger at 27 and so profiled that as collar 23 and plug 10 are rotated through a small angle as a result of restrictions within the labyrinth of the discriminator, the external cam schematically attached to the trigger at section 27 will operate the contacts **27*c* indicated to actuate a silent or audible alarm circuit. Therefore, if the same or greater angular displacement has been preceded by a key-coded linear displacement of collar 23 the cam will be out of alignment with the leaf-spring contact-follower and no contact closure or alarm will result. For many applications, the designer of an improved security lock, incorporating the improvements of this invention may choose to use the integral trap alarm switch contact, shown as auxilliary FIG. 6, wherein 41, the mechanical equivalent of stop pin 39 mounted in threaded hole 40 in shell 8, is a button-headed electrical conducting screw molded into or otherwise supported in an insulating bushing mounted in the wall of shell 8 in the same position as shown for the mechanical stop pin 39 in FIGS. 1 and 3–5. This insulated pin, which may be connected to a security surveillance circuit by any convenient means, including the spring contact diagramed in FIG. 6, will complete a circuit to ground when the discriminator trap is sprung as by a hostile entry attempt, because it will make electrical as well as physical contact between the one end of the labyrinth 24 and stop pin 41. This integral switch may be connected into an electrical or electronic logic circuit together with a second switch responding only to linear displacement of extending trigger pin 27 to accomplish a variety of sophisticated alarm or surveillance functions. It is simple by known circuits to provide the logic that is provided electromechanically by the slotted cam and follower operated switch of the schematic portion of FIG. 3**.

Other details of practical utility shown by FIGS. 1–6 include a projection boss 35 on the rear of cam 34 which can accurately and conveniently communicate angular plug position information to external mechanical or electrical security system components and the provision of an on-axis assembly through-hole 38, intersecting the axis of trigger pin 33 to be used in the assembly of trigger pin 33, and collar 23 within bore 9 of plug 10, while collar 23 is rotated and held in a position near the rear of bore section 22, in which holes 32 in collar 23 come into alignment with the assembly-disassembly hole, and the length of pin 33 does not exceed the inside diameter of the enlarged section 22 of bore 9 in shell 8.

Figure 7:
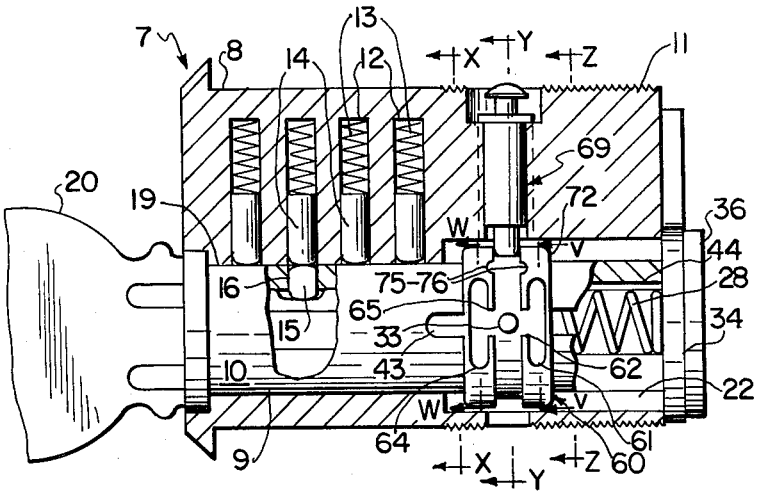
FIG. 7 is a sectional view of another embodiment of the lock cylinder of the present invention showing a different and double-acting lock-up trigger and pin mechanism than that of the embodiment of FIGS. 1 to 5.
Figure 8:
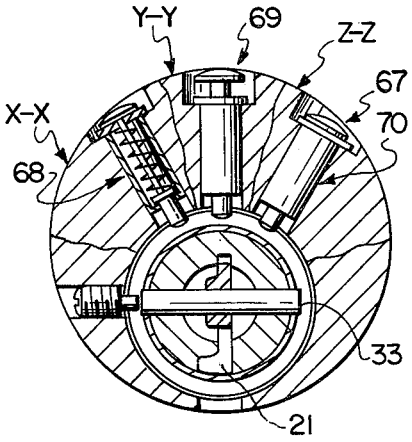
FIG. 8 is a multiple section along lines x—x, y—y and z—z, taken through the respective planes indicated in FIG. 7, and showing the attachment of the trigger-pin to the double acting locking element and the relative locations of optional, electrical, position-sensing, switching devices.

The embodiment of FIGS. 7 and 8 derives additional advantages through modification of the booby-trap feature of the first embodiment. It's modified discriminator booby-trap provides a two-way trapping feature through the use of a double labyrinth contained in a spool-like collar 60, which performs the functions of collar 23 and has additional features. The double collar 60 not only includes the equivalent of labyrinth notch 24 and restricted end portion 25 but also includes a second labyrinth 64, having a second restricted end portion 66, axially opposite end portion 25. FIG. 7 shows this generally spool shaped, modified collar 60 in the position it assumes along the plug 10 when a properly coded key is fully inserted in the keyway. As shown by details and FIGS. 7 and 8, trigger pin 33 passes through the keyway and is here employed to directly contact a coded linear displacement, open-sided, notch in the end of the key whose entry into the keyway displaces collar 60 only that distance from its spring held position of rest, at the inner end of enlarged section 22 of bore 9, necessary to move labyrinth 64 out of alignment with stop pin 39 (which is mounted radially in the plane indicated in FIG. 8) and into alignment with clear channel 62 as shown between the spool ends at which locations there is offered no impediment to the rotation of key 20 together with plug 10 within the lock cylinder. Should the key communicate too little displacement, stop pin 39 will limit the plug's angular displacement to a small angle within the confines of labyrinth 61. Should the key contain the wrong end coding, and thrust collar 60 beyond its unimpeded rotation position, stop pin 39 will lie within the domain of labyrinth 60 and will therefore limit the plug's displacement to a small angle even if it's pin-tumbler-positioning bitting contains the corect coding. In the unlikely event that the would-be intruder is aware of the necessity of properly displacing labyrinth collar 60, as part of a lock picking procedure, he will have to divise an impractical special tool to displace it and this tool will not communicate to him information needed to move the spool to its free-to-rotate position. In any event, the presence of such a hypothetical tool in the keyway will greatly impede if not preclude lock picking procedures.

Figure 9:
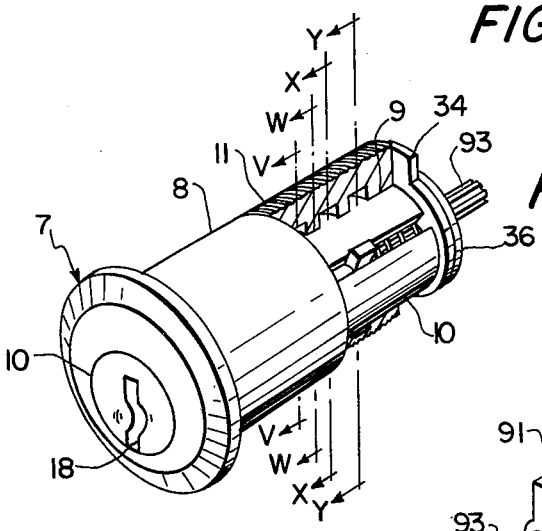
FIG. 9 is a partially sectioned perspective view of another embodiment of the invention in which the labyrinth and engaging lug of the booby-trap have an inverse relationship structurally to the previous figures, and the restraining pin or lug projects radially from the plug to engage the analogy of the T-shaped slots of the other embodiments and in which this analogy comprises a plurality of communicating and selectively blocked spaced circular grooves provided in the surrounding bore of the cylinder.

In contrast to the vertical axis position of stop pin 39 in shell 8 of the first embodiment, stop pin 39 in this embodiment is mounted in a tapped hole in shell 8, in a horizontal position with its axis intersecting the center of the plug. In the upper portion of the plug, threaded section 11, there now are assembled instead three-discriminator-condition-sensing elements in the form of a pre-assembled, spring-loaded, push-rod cartridge pressed into three radially oriented bores, each having its principal axis in a different but parallel plane, perpendicular to the principal axis of the cylinder and intersecting the discriminator spool collar 60 in the planes designated x-x, y-y, and z-z, in FIG. 7. Supplementary partial sections w-w and v-v of FIG. 9 are taken in intermediate planes between x-x and y-y and z-z. They further disclose the orientation and relative positions of the caming detents in the spools and of the relative position of the cam-following push rod cartridge subassemblies that sense and convey discriminator status information to external lock mechanisms or operate suitable miniature switches which may be the leaf or plunger operated displacement sensitive type, sold as "Microswitches" (TM) and well known as contemporary electrical components.

Of the 3 push rod cartridges, 67, 68 and 69, the one 68 nearest the front of the cylinder will normally (without a key thrust fully into the plug) have the end of its rod spring-force-extended down into cam detent 73 which is a cylindrical notch in the periphery of the near end 71 of spool shaped labyrinth collar 60 at the angle indicated "a" in FIGS. 8, 9, 9A and 9B. When spool collar 60 is properly displaced by a coded key positioned as in FIG. 7, this rod end will be entirely out of alignment with this spool end and will be suspended in enlarged bore 22 of shell 8. Another push rod cartridge 67, nearest the rear of the cylinder shell 8 is so mounted in a plane designated z-z and with angular orientation designated "b" as to cause its cam follower to be suspended completely out of alignment with any position of collar 60 but to come into alignment with spool end 72 if and only if collar 60 is displaced farther rearwardly (by insertion of a lock invading implement or improperly end coded key) than would result from the insertion of a properly coded key.

Should any sequence of tumbler picking procedures succeed while labyrinths 61 or 64 remain in alignment with stop pin 39, not only will there result the sort of lock-up described in the first embodiment of this invention, but one or the other of push rods of cartridges 67 or 68 will be displaced axially by being forced up out of its detent to extend its button-head near the periphery of shell 8, to communicate this event to the actuator of a displacement sensitive electrical switch or the like to communicate discriminator derived security information.

A third sensing unit 69, of the same type as 67 and 68 may also be utilized if desired. It's purpose is to provide the input for a time-paced-logic security circuit in which "condition a", with no key in the keyway, the cam follower end of this push-rod cartridge rests on the spool end 72, but in "condition b" the cam follower is aligned with central spool section 63 when a properly end-coded key is in the keyway as disclosed in FIG. 7.

When in condition A, the button head of this push rod is raised to communicate a first (circuit opened or a circuit closed) sense to a central security circuit, and when in condition b, the button head is lowered into opposite partial detents (not shown but similar to 75 and 76) to communicate the opposite sense. Through the use of well known components and circuits, it is readily provided that a time delayed alarm signal will result even if collar 60 is somehow fortuitously positioned at its safe, non-booby-trapping position during the course of a tumbler-picking procedure. Unless all the tumblers are immediately picked and released and the plug is turned to open the lock within a specified interval, e.g., one-half second, undetected tumbler-picking of this cylinder is made an impossible task.

An alarm cancelation signal, indicating the initiation of appreciable turning of the plug through an angle indicative of key initiated rotation may be obtained from a partial detent, consisting of partial detents 75 and 76 in the interfaces of spool ends 71, 72 to produce a suitable push-rod communicated displacement to be communicated to a sensitive switch so connected in the secuirty or surveillance circuit that it negates the impending time-delayed alarm signal. Other parts and functions of this embodiment follow those of the embodiment first described herein. In the matter of assembly at manufacture, trigger pin 33 may be inserted conviently through bore 67 provided for push-rod cartridge 69 which is bored completely through shell 8 to facilitate this operation.

A third embodiment of the invention disclosed herein employs an inverse relationship of the booby-trapping discriminator's labyrinth and its key trigger displaceable locking pin or lug. The basic structure of this embodiment retains the full load bearing capability of the shell bore by maintaining its diameter constant throughout the length of the shell. Additionally, there is retained much of the space in the rear of the solid plug to accomodate such sensing elements as are described. The labyrinth, having been machined into the body of the cylinder, is stationary and is engaged by and functions with the key-displaceable lug projecting from a clearance slot in the plug. Its discriminator performs all of the double acting, mechanical booby-trap lock-up functions of the descriminator assembly of the second embodiment.

Figure 10:
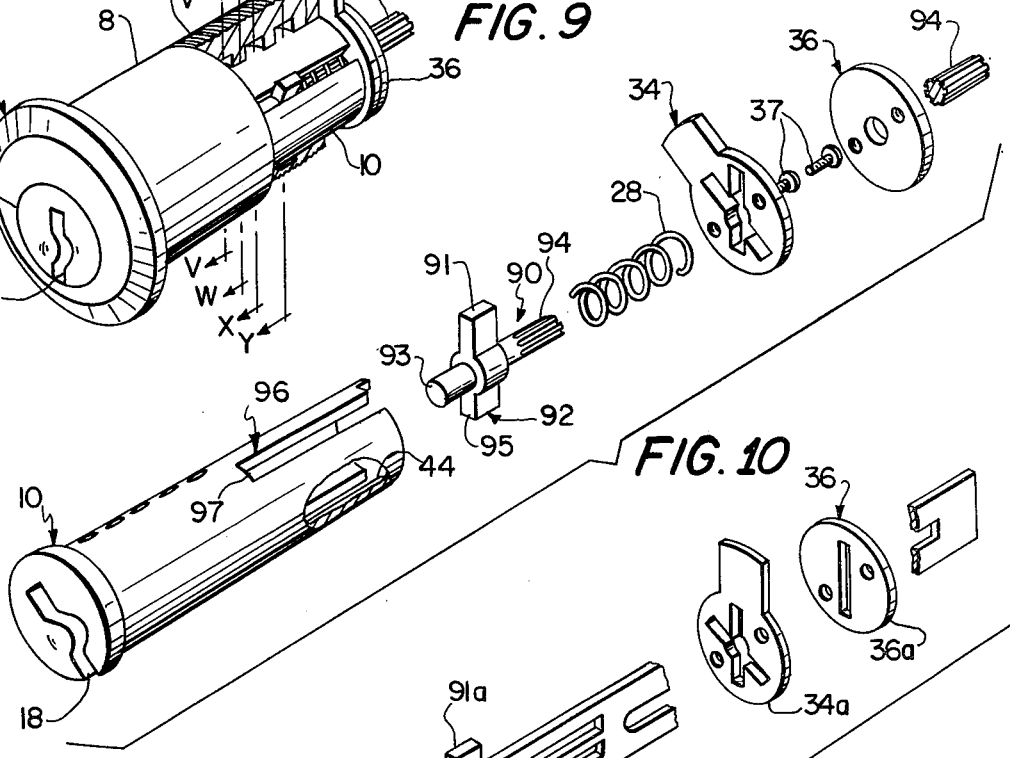
FIG. 10 is an exploded perspective view of the plug and key-displaceable locking lug and other lock-up components, assembled within or attached to the plug. A stabilizing pin of splined or other non-circular cross section extends for an optional length to communicate to external sensing and/or switching means, angular and linear displacement information defining the status of the lock's trapping and lock-up elements.
Figure 11:
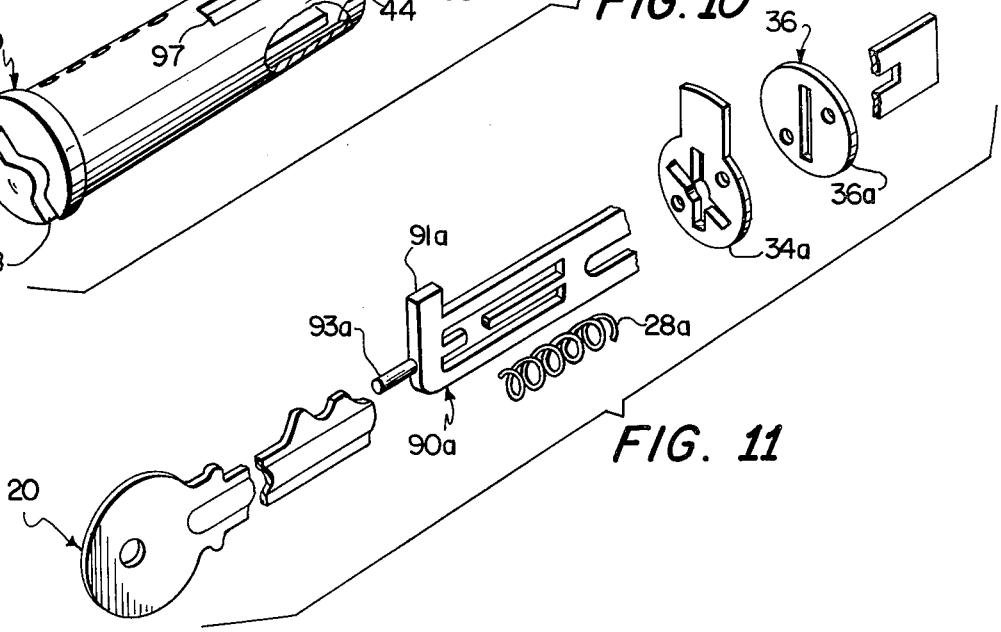
FIG. 11 is a view in perspective of an alternate, stamped sheet metal form of key-displaceable, labyrinth-engaging, lock-up lug, particularly suited through optional extension of its flat rectangular form through the rear of the plug for engagement with or coupling to any one of a wide variety of current design lock mechanisms.
Figure 9A:
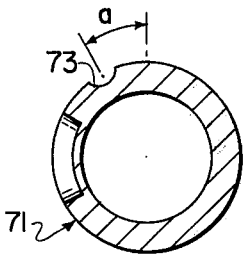
FIGS. 9A and 9B are sectional views taken along lines w—w and v—v, respectively.
Figure 9B:
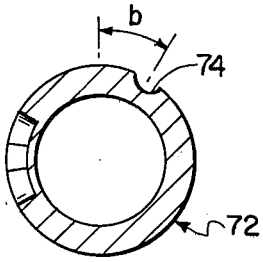
Figure 12A:
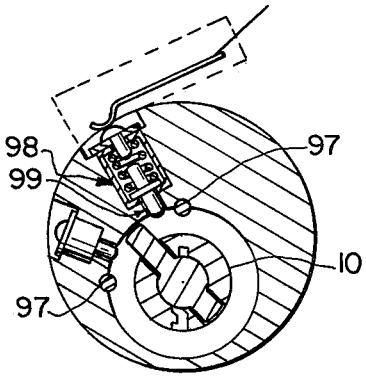
FIGS. 12A, 12B, and 12C are successive cross sections, taken through the cylinder and plug of FIG. 9, along the spaced parallel planes indicated v—v, w—w, and x—x, and showing the relationships between the key-displacable lug assembly and the paths provided by the selectively blocked surrounding labyrinth.

The salient features of the third embodiment are shown in FIGS. 9 and 10, and an alternate trigger-lug assembly is shown in FIG. 11, with its components 91*a*, 93*a*, 28*a*, 34*a*, 36*a*, etc., corresponding to those having the same numerals without subscripts. FIGS. 12*a* through 12*d* are sectional views that show locations of the requisite lug stops and passages through the labyrinth partition and additionally disclose the locations of (optional) electrical sensing elements for the purposes previously described herein. FIG. 12*e* additionally shows an optical method of transferring information through the use of a fibre optics bundle or light pipe to convey light down into and up from the reflective end 91 of labyrinth traversing lock-up lug 95, of the discriminator mechanism. This non-contacting sensing means has no moving parts, can be interrogated from a remote location at will, and has no electrical contact to preclude its use in certain hazardous environments.

Throughout these several figures, like numbers are used for parts that closely correspond to those of the embodiments previously described.

Beginning with FIG. 9, there is shown a lock cylinder 7 of the multiple-pin-tumbler type in which the shell is designated 8 and the rear, usually threaded, solid portion of the shell is designated 11. In its bore 9 there is assembled plug 10 which contains a keyway 18, and further has been slotted from the rear with the center of the slot 90 in the plane of the axis of the plug but displaced 45 degrees from the plane intersecting the axis of its pin tumbler bores, not shown. Three annular passages, v, x, and y are shown machined into the rear section of bore 9 and separated by two partitions. The widths of these passages designated v, w and x, slightly exceed the width of extending lug portion 91 of trigger assembly 90. The wall thickness of the two partitions between the annular passages are equal to or less than the widths of the passages which communicate at only one opening through each of the two partitions along a plane intersected by the plug-slot-guided lug 91 at its locked position.

Plug 10 has a conventional cam or operator 34 secured to its rear end through use of end plate 36 and two screws (not visible in this view). In addition, there extends (for an optional length) through clearance holes in 34 and 36 the squared, splined or flatted shaft portion of trigger assembly 90. This is intended to be used to transmit both angular and linear displacement information on discriminator status to an external lock mechanism or to electrical switches or other devices. It will be noted that the head of trigger 90 has two lugs of which the longer one, 91, projects out of plug 10 and preferrably rides against the cylindrical wall at the bottom of the annular groove of a labyrinth passage for stability. It also has a shorter extension or lug 92 that does not extend beyond the periphery of the plug but supplies strength and rotational stability to the trigger assembly when both lugs are mounted in trigger clearance slot 96. The form and dimensions of extending finger end 93 of the trigger assembly that contacts a coded section of key 20 can be variously shaped and dimensioned to restrict its accessibility to other than a coded key. It is required that it not project into the keyway so far as to interfere with the nearest pin tumblers yet displace the trigger one passage width plus one partition width upon the full insertion of a properly coded key.

Normally, when there is no key 20 in keyway 18, the common front surfaces 95 of lugs 91 and 92 are pressed against the end 97 of opposing slots 35 by spring 29 which is assembled over shaft 94 of the trigger assembly and is compressed at assembly within plug bore 44 and retained by cam 34 and end plate 36, both being secured by two machine screws 37 passing through their clearance holes and threaded into the end of the plug.

Figure 12B:
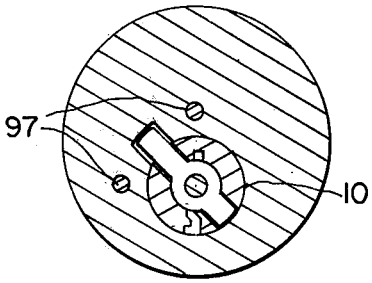
Figure 12C:
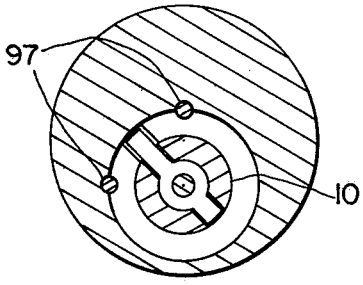
Figure 12D:
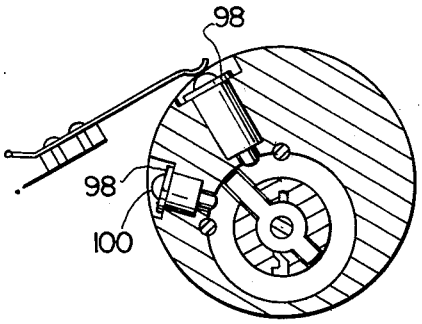
FIG. 12D (as well as 12A) also shows the locations of electrical contact or other intruder-sensor elements applicable to this embodiment and others.
Figure 12E:
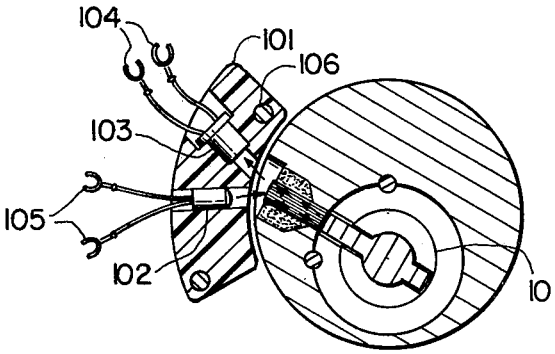
FIG. 12E shows the practical incorporation of a fiber optics light relaying bundle, cooperating with a solid state (light emitting diode) external light source and photo-sensing (photo-diode) detector to communicate lock status information to centralized security systems by non-contact means, as required in hazardous, explosive vapor prevalent environments.

Labyrinth passage v has a passageway, shown in FIG. 12*b*, which is so located that it is in line with slot trigger 95 and so dimensioned that it offers the clearance necessary to permit lug 91 to be displaced linearly and axially, and pass through it into passage x, upon full insertion of a properly coded key into keyway 18. The restricted angular rotation permitted lugs 91, before the key is fully inserted in the keyway, and plug 10, and while lug 91 remains within labyrinth passage v is limited by two stop pins 97 fixed within shell section 11, as shown by FIG. 11*a*, taken on section v-v. The angular displacement in either direction is insufficient to unlock the mechanism of any lock in which this cylinder may be assembled. Lug 91 will not be called upon to make the limited angular traverse of this first passageway nor will it contact the stops (which limit such a traverse in either direction) by any conceivable use of a fully coded key in the keyway. Such angular displacement can occur only if the pin tumblers have been picked and some other means is brought into play to rotate the plug and open the lock, or if a "Security Officer Test Key", one having the correct tumbler lifting code but communicating an erroneous trigger positioning code is used in the keyway.

Should a booby-trap lock-up result there will also be established an electrical contact between lug 91 and a spring loaded insulated contact cartridge 98, which has a button shaped termination to which an external electrical circuit may be completed.

The stop pins 97 shown may be of the hollow, open-sided, expanding type, marketed as "Roll Pins" (TM) or their equivalent and may be installed readily by insertion through the in-line holes drilled from the rear axially into the shell and through both partitions and into the shell beyond the innermost wall of the first annular passage. Four pins are installed as shown in FIGS. 12*a* through 12*d*. Of these, two bridge only the passage in the most remote annular passage "v" and two bridge the passage in the most remote annular passage "y". None projects into the central passage. To facilitate tooling and assembly, the two pins blocking passage "v" may be of a smaller diameter than those of passage "y" with corresponding differences in the diameters of the holes in which they are installed.

FIG. 12*a*, a section taken in the plane indicated "v-v", illustrates the construction and location of two insulated, spring-loaded, contact cartridges 98 that can close an external circuit to ground only when the discriminator trap is in the sprung condition indicating a partially successful unauthorized attempt. Cartridge 98 consists of an insulated cartridge housing having a metallic button 100 at the top that in turn is connected by an internal metallic spring to a limited travel electrical contact 99 that projects from its swaged-in bottom a distance sufficient to make good electrical (grounding) contact with the end of trigger lug 91. Its connection into a security or alarm circuit is through bottom contact 100 by any known means including the unnumbered leaf spring contact shown schematically in FIGS. 12*a* and 12*d*.

FIG. 12*e* which is also a section taken along "v-v" of FIG. 9, incorporates a "FOB" (fibre-optics bundle). This bundle or "stick" contains a multiplicity of transparent glass or plastic threads bonded together after being "sheathed" (coated) with a material of a lower index refraction by methods well known in contemporary fibre optics technology to form an efficient light conductor which is then placed in a bore in shell 8. The mounting of the FOB may be by "potting" with a suitable plastic compound such as a two-component, opaque pigment filled, epoxy compound to locate this light pipe for use as an optical relay. It has the capability of virtually raising the image of the white reflective end of lug 91 to the outer surface of the FOB. Supplementing the monitored lock cylinder in this instance is a cooperating module 101 that contains a solid state "LED" (light emitting diode) which may have a lens end to direct light or non-visible radiant energy down through the FOB into the labrynth section below. For this purpose the labrynth and the lug are treated to be essentially non-reflective except for the end face of the lug which is preferably plated or painted with a reflective coating such as white paint. A large part of such useful visible (or infra red) energy as is produced by the LED, falls on the near end of the FOB, impinges on and is reflected back from the end of the lug (when in the booby-trapped position) and is introduced back into the FOB to emerge with a wide angle of distribution from its outboard surface. The small arrows on FIG. 12*e* indicate these optical paths generally. A useful amount of the emerging light will fall upon the window of photo diode 103 which by means of circuits and components now well known, transmits a signal to security or survellance equipment. It should be noted that although, in the several embodyments of this invention disclosed herein there are illustrations showing the practicality of the use of several discriminator condition sensing elements in or cooperating with the basic lock cylinder, there are, many applications in which a single sensor would be adequate. For either single or multiple sensors, however, the solid state FOB arrangement of or obvious modification of FIG. 12*e* will offer a number of advantages over the contact types, such as solid state modules which can be produced and supplied as a reliable auxilliary component suitable for use in either grounded or ungrounded surveillance circuits.

Because no alarm or security device or system is useful absent a means for verification of its function at time of installation, and for periodic testing of its continued ability to fulfill its function, it has been an object of this invention to provide for such verification. To this end, every manufacturer producing a lock cylinder according to this invention can readily devise a set of "Security Officer's Test Keys" to communicate to the trigger of the discriminator a code which is erroneous by one full increment. With these keys and a normal fully coded key, complete operational tests of the discriminators is possible. Master keying will not prevent the use of these test keys, indeed they may well be master keys themselves if desired.

What is claimed is:

1. A key operated lock cylinder comprising:

a shell having a longitudinally extending bore;

a plug rotatively mounted in said bore and having a keyway including an opening for insertion of a key, said plug having a locked position and an unlocked position;

locking means for restraining said plug in said locked position, said locking means being released when a key corresponding to said locking means is fully inserted into said keyway;

a rotation-limiting pin radially mounted in said shell;

restraining notch means in a first labyrinth means operatively associated with said rotation limiting pin to prevent rotation of said plug to said unlocked position;

resilient means for biasing engagement of said pin and labyrinth means to normally hold said rotation limiting pin in said restraining notch means;

said corresponding key displacing the relative positions of said pin and restraining notch means longitudinally of said bore, when said key is fully inserted, so that said pin is out of said restraining notch means and said labyrinth means to allow said plug to rotate to said unlocked position; and a collar slidably mounted in said shell and operatively coupled to rotate with said plug, said collar including;

said first labyrinth means formed in said collar and having an enlarged portion constituting said restraining notch means, a restricted end portion, and an opening, said restricted end portion being located near the opening of said first labyrinth means, said enlarged portion allowing a limited rotation of said plug when said locking means is released, said restricted end portion preventing the movement of said pin out of said first labyrinth means unless said plug is positioned in said locked position;

second labyrinth means for receiving said rotation limiting pin when said collar is depressed farther than said corresponding key would depress said collar when fully inserted into said collar; and a slot positioned between said first labyrinth means and said second labyrinth means, said slot allowing said collar to rotate with said plug to said unlocked position when said collar is displaced a predetermined distance longitudinally of said bore by said corresponding key.

2. The lock cylinder of claim 1, wherein said first labyrinth means is positioned on the edge of said collar nearest the opening of said keyway.

3. The lock cylinder of claim 1, wherein said second labyrinth means has an enlarged portion and a restricted end portion, said restricted end portion being located near the opening of said second labyrinth, said enlarged portion allowing a limited rotation of said plug when said locking means is released, said restricted end portion preventing the movement of said pin out of the enlarged portion of said second labyrinth means, unless said plug is positioned in said locked position.

4. The lock cylinder of claim 1, wherein said collar further includes a trigger means positioned such that the end of said corresponding key will strike said trigger means to slide said collar, thereby disengaging said first labyrinth means from said pin.

5. The lock cylinder of claim 4, wherein said trigger means is a finger projecting into said keyway from the edge of said collar nearest the opening of said keyway.

6. The lock cylinder of claim 4, wherein said collar is a cylindrical sleeve; and wherein said trigger means is a trigger pin extending substantially across the diameter of said cylindrical sleeve.

7. The lock cylinder of claim 1, further comprising;

a trigger assembly disposed inside said plug and operatively connected to said collar, said trigger assembly having a trigger formed on the end portion of said trigger assembly nearest the opening of said keyway;

said trigger being positioned such that the end of the corresponding key will strike said trigger to slide said trigger assembly and said collar longitudinally of said bore, thereby disengaging said restraining notch means from said pin.

8. The lock cylinder of claim 1, further comprising:

a signaling pin operatively associated with said collar for actuating a signaling device when said collar is radially displaced without being slid to the position that it would assume when linearly displaced by the fully inserted corresponding key.

9. The lock cylinder of claim 3, wherein said bias means is a coil spring disposed within the plug supporting said collar.

10. A key operated lock cylinder comprising:

a shell having a longitudinally extending bore;

a plug rotatively mounted in said bore and having a keyway including an opening for insertion of a key, said plug having a locked position and an unlocked position;

locking means for restraining said plug in said locked position, said locking means being released when a key corresponding to said locking means is fully inserted into said keyway;

an assembly slidably mounted in said bore and operatively coupled to rotate with said plug;

a rotation-limiting pin formed on said assembly;

restraining notch means in a labyrinth means operatively associated with said rotation limiting pin to prevent rotation of said plug to said unlocked position, said restraining notch means and labyrinth means being formed in said shell;

resilient means for biasing engagement of said pin and labyrinth means to normally hold said rotation limiting pin in said restraining notch means;

said corresponding key displacing the relative positions of said pin and restraining notch means longitudinally of said bore, when said key is fully inserted, so that said pin is out of said restraining notch means and said labyrinth means to allow said plug to rotate to said unlocked position;

said labyrinth means having an enlarged portion constituting said restraining notch means, a restricted end portion, and an opening, said restricted end portion being located near the opening of said labyrinth means, said enlarged portion allowing a limited rotation of said plug when said locking means is released, said restricted end portion preventing the movement of said pin out of said labyrinth means unless said plug is positioned in said locked position.

11. The lock cylinder of claim 10, wherein said shell further includes an additional means formed therein for receiving said rotation limiting pin when said pin assembly is depressed further than said corresponding key would depress said pin assembly when fully inserted into said plug; and a slot positioned between said labyrinth means and said additional labyrinth means, said slot allowing said pin assembly to rotate with said plug when said pin assembly is depressed a predetermined distance longitudinally of said bore by said corresponding key.

12. The lock cylinder of claim 11, wherein said additional labyrinth means has an enlarged portion and a restricted end portion, said restricted end portion being located near the opening of said additional means, said enlarged portion allowing a limited rotation of said plug when said locking menas is released, said restricted end portion preventing the movement of said pin assembly away from said enlarged portion of said labyrinth or of said additional labyrinth unless said plug is positioned in said locked position.

13. The lock cylinder of claim 10, wherein said pin assembly further includes a trigger means positioned such that the end of said corresponding key will strike said trigger means to slide said pin assembly, thereby disengaging said labyrinth from said pin.

14. The lock cylinder of claim 13, wherein said trigger means is a finger projecting into said keyway from the edge of said pin assembly nearest the opening of said keyway.

15. The lock cylinder of claim 10, further comprising:

a signaling pin operatively connected to said pin assembly for actuating a signaling device when said pin assembly is slid farther than the fully inserted corresponding key would slide it.

16. The lock cylinder of claim 13, wherein said means for biasing is a coil spring disposed around said pin assembly and having a diameter smaller than the diameter of said cylinder plug.

17. The lock cylinder of claim 1, wherein said collar shell and rotation limiting pin are electrically conductive;

wherein said rotation limiting pin is electrically isolated from said shell; and wherein an electrical alarm path is created between said rotation limiting pin and said shell when said rotation limiting pin contacts said collar.

18. The lock cylinder of claim 1, further comprising:

switch contacts for creating an electrical alarm path;

a cam normally operatively coupled to said switch contacts to connect said contacts together when said plug is rotated with said pin being disposed within said restraining notch means;

said corresponding key moving said cam away from said switch contacts when said key is fully inserted to thereby prevent the interconnection of said switch contacts when said plug is rotated.

19. The lock cylinder of claim 1, further comprising;

a plug position sensor including;

a cylindrical housing disposed radially in said shell;

a plunger slidably mounted in said housing;

biasing means for maintaining said plunger in contact with said collar; and a switch operatively connected to said plunger for producing information indicative of the position of said plunger;

said plunger sensing the position of said collar by sensing the alignment of said labyrinth means therewith.

20. The lock cylinder of claim 10, further comprising:

a plug position sensor including;

a cylindrical housing disposed radially in said shell;

a plunger slidably mounted in said housing;

biasing means for positioning said plunger in said bore; and a switch operatively connected to said plunger for producing information indicative of the position of said plunger;

said plunger sensing the position of said pin assembly by sensing the alignment of said rotation limiting pin therewith.

21. The lock cylinder of claim 10, further comprising;

a plug position sensor including;

an optical passageway radially extending from said bore to the exterior of said shell;

a radiant energy source for transmitting radiant energy through said passageway into said bore;

a reflective coating formed on the end of said rotation limiting pin; and a radiant energy detector for sensing radiation reflected back through said passageway to the exterior of said shell by said reflective coating when said rotation limiting pin is positioned directly under said passageway.

22. A key operated lock cylinder comprising:

a shell having a longitudinally extending bore;

a plug rotatively mounted in said bore and having a keyway including an opening for insertion of a key, said plug having a locked position and an unlocked position;

locking means for restraining said plug in said locked position, said locking means being released when a key corresponding to said locking means is fully inserted into said keyway;

mechanical discriminator means for differentiating between a correctly coded key and an unauthorized device, by sensing a characteristic dimension of said key or device when fully inserted into said keyway, said mechanical discriminator means preventing the rotation of said plug responsive to the insertion of said unauthorized device; and a position sensing transducer means, said transducer means operatively associated with said mechanical discriminator means, said transducer means being actuated by said mechanical discriminator means when an unauthorized entry attempt is made by said unauthorized device;

said mechanical discriminator means including an element movable both longitudinally and angularly with respect to said bore in response to longitudinal and angular movements of said key or unauthorized device, said transducer means sensing longitudinal and angular movements of said element which would be caused by elements other than said correctly coded key to generate an alarm signal.

23. A key operated lock cylinder comprising:

a shell having a longitudinally extending bore;

a plug rotatively mounted in said bore and having a keyway including an opening for insertion of a key, said plug having a locked position and an unlocked position;

locking means for restraining said plug in said locked position, said locking means being released when a key corresponding to said locking means is fully inserted into said keyway;

a rotation limiting pin;

first labyrinth means including a first restraining notch means operatively associated with said rotation limiting pin to prevent rotation of said plug to said unlocked position;

second labyrinth means including a second restraining notch means operatively associated with said rotation limiting pin to prevent rotation of said plug to said unlocked position;

a slot positioned between said first and second labyrinth means, said slot allowing said plug to rotate to said unlocked position when said rotation limiting pin is positioned relative to said slot and first and second labyrinth means by a corresponding key when fully inserted a predetermined distance longitudinally of said bore;

resilient means for biasing engagement between said pin and said first labyrinth means to normally hold said rotation limiting pin in said first restraining notch means;

said first and second labyrinth means each having an enlarged end portion constituting a respective one of said first and second restraining notch means, a restricted end portion, and an opening, said restricted end portions being located near the openings of said first and second labyrinth means, said enlarged portions allowing only a limited rotation of said plug when said locking means is released, said first and second restricted end portions preventing the movement of said pin out of said first or second labyrinth means unless said plug is positioned in said locked position.

* * * * *